US006938763B2

(12) United States Patent
Chen

(10) Patent No.: US 6,938,763 B2
(45) Date of Patent: Sep. 6, 2005

(54) APPARATUS FOR CARRYING GOLF CLUBS

(75) Inventor: Changfu Chen, Taipei (TW)

(73) Assignee: Chenterlon Inc., Taichung (TW)

( * ) Notice: Subject to any disclaimer, the term of this patent is extended or adjusted under 35 U.S.C. 154(b) by 0 days.

(21) Appl. No.: 10/672,834

(22) Filed: Sep. 26, 2003

(65) Prior Publication Data

US 2005/0067306 A1 Mar. 31, 2005

(51) Int. Cl.[7] ..... A63B 55/04
(52) U.S. Cl. ..... 206/315.6; 206/315.3
(58) Field of Search ..... 206/315.3, 315.6; 211/70.2

(56) References Cited

U.S. PATENT DOCUMENTS 4,311,178 A * 1/1982 Kennedy ..... 206/315.6
4,691,823 A * 9/1987 Pape ..... 206/315.6
4,768,650 A * 9/1988 Chancellor, Jr. ..... 206/315.3
5,148,915 A * 9/1992 Ryan ..... 206/315.6
5,971,147 A * 10/1999 Sutter ..... 206/315.6
6,598,743 B1 * 7/2003 Puskaric ..... 206/315.6
2004/0035729 A1 * 2/2004 Chang et al. ..... 206/315.6

* cited by examiner

*Primary Examiner*—T. Mai
(74) *Attorney, Agent, or Firm*—Alan D. Kamrath; Nikolai & Mersereau, P.A.

(57) ABSTRACT

A club-carrying apparatus includes a bag and a frame. The frame includes an annular element, a sternum-like element and at least one rib-like element. The annular element is attached to an upper portion of the bag. The sternum-like element extends from the annular element and includes a bone and a skin covering the bone. The rib-like element intersects the sternum-like element and includes a bone and a skin covering the bone. Each of two partitions includes a lower portion attached to the bag and an upper portion attached to the bone of the sternum-like element. Another partition includes a lower portion attached to the bag and an upper portion attached to the bone of the rib-like element.

13 Claims, 6 Drawing Sheets

APPARATUS FOR CARRYING GOLF CLUBS

FIELD OF INVENTION

The present invention relates to a club-carrying apparatus.

BACKGROUND OF INVENTION

Referring to FIG. 5, a golf club 60 is inserted in a conventional club-carrying apparatus 62. The club-carrying apparatus 62 includes a bag 64 and a frame 66 attached to an upper portion of the bag 64. Referring to FIG. 6, the frame 66 includes an annular element 68, a sternum-like element 70 and three rib-like elements 72 (only two are shown). The annular element 68 provides rigidity to the bag 64. The sternum-like element 70 and the rib-like elements 72 separate golf clubs such as the golf club 60. The sternum-like element 70 is divided into three sections by the rib-like elements 72. A partition 74 includes an upper portion wrapping and holding to each section of the sternum-like element 70 and a lower portion attached to the bottom of the bag 64 via sewing, adhesion or any other proper manners. A partition 76 includes an upper portion wrapping and holding to each rib-like element 72 and a lower portion attached to the bottom of the bag 64 via sewing, adhesion or any other proper manners. However, the golf clubs 60 easily wear out the upper portions of the partitions 74 and 76. It is difficult to replace such a used partition with a new one.

The present invention is therefore intended to obviate or at least alleviate the problems encountered in the prior art.

SUMMARY OF INVENTION

The primary objective of the present invention is to provide a club-carrying apparatus with a bag, a frame attached to the bag and partitions attached to and protected by the frame.

According to the present invention, a club-carrying apparatus includes a bag and a frame. The frame includes an annular element, a sternum-like element and at least one rib-like element. The annular element is attached to an upper portion of the bag. The sternum-like element extends from the annular element and includes a bone and a skin covering the bone. The rib-like element intersects the sternum-like element and includes a bone and a skin covering the bone. Each of two partitions includes a lower portion attached to the bag and an upper portion attached to the bone of the sternum-like element. Another partition includes a lower portion attached to the bag and an upper portion attached to the bone of the rib-like element.

Other objectives, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
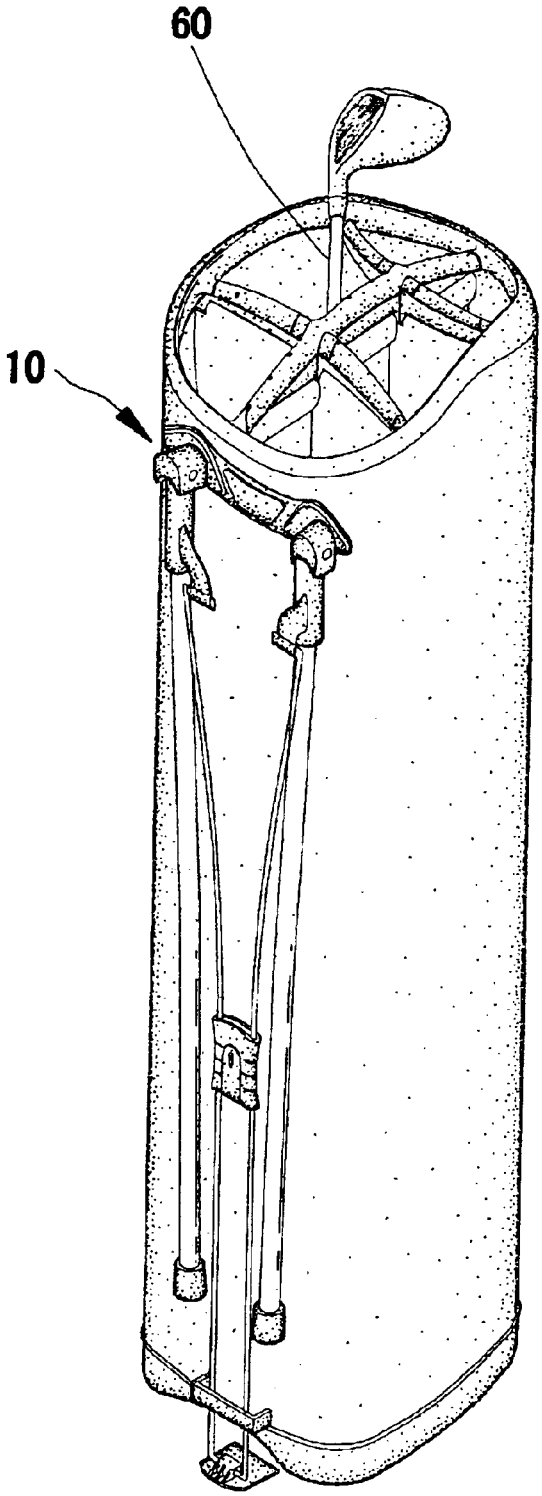
FIG. 1 is a perspective view of a golf club inserted in a club-carrying apparatus according to the preferred embodiment of the present invention.

Referring to FIG. 1, a golf club 60 is put in a club-carrying apparatus 10 according to the preferred embodiment of the present invention.

Figure 2:
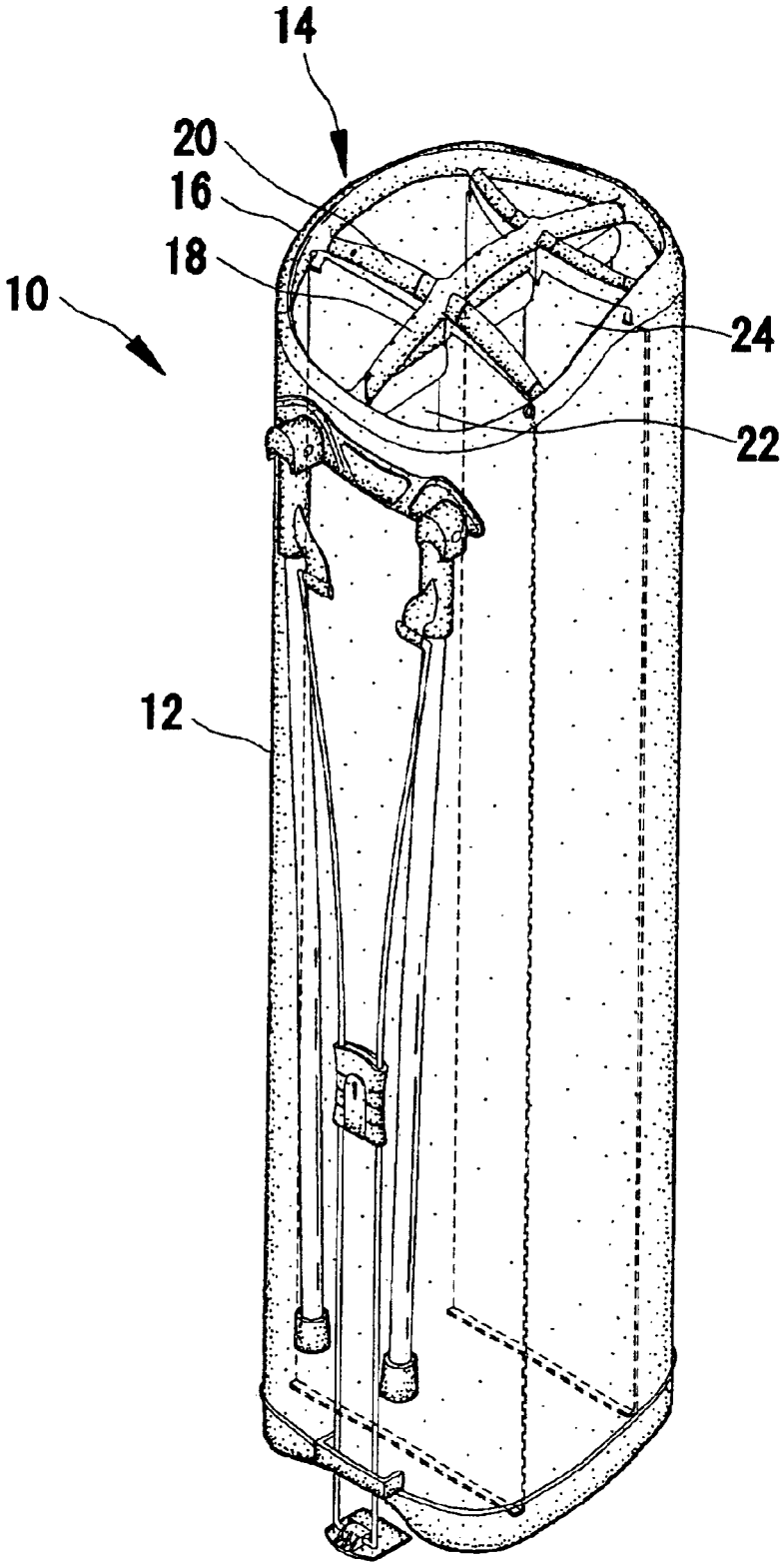
FIG. 2 is a perspective view of the club-carrying apparatus of FIG. 1.

Referring to FIG. 2, the club-carrying apparatus 10 includes a bag 12 and a frame 14 attached to an upper portion of the bag 12. The frame 14 includes an annular element 16, a sternum-like element 18 and two rib-like elements 20 intersecting the sternum-like element 18. The sternum-like element 18 is divided into three sections by the rib-like elements 20. The annular element 16 provides rigidity to the bag 12. The sternum-like element 18 and the rib-like elements 20 separate golf clubs such as the golf club 60 from each other.

To separate the golf clubs, three partitions 22 and two partitions 24 are used. Each of the partitions 22 includes a lower portion attached to a bottom of the bag 12 and an upper portion attached to one of the sections of the sternum-like element 18. Each of the partitions 24 includes a lower portion attached to the bottom of the bag 12 and an upper portion attached to one of the rib-like elements 20. The lower portions of the partitions 22 and 24 can be attached to the bottom of the bag 12 by sewing, adhesion or in any other proper manners.

Figure 3:
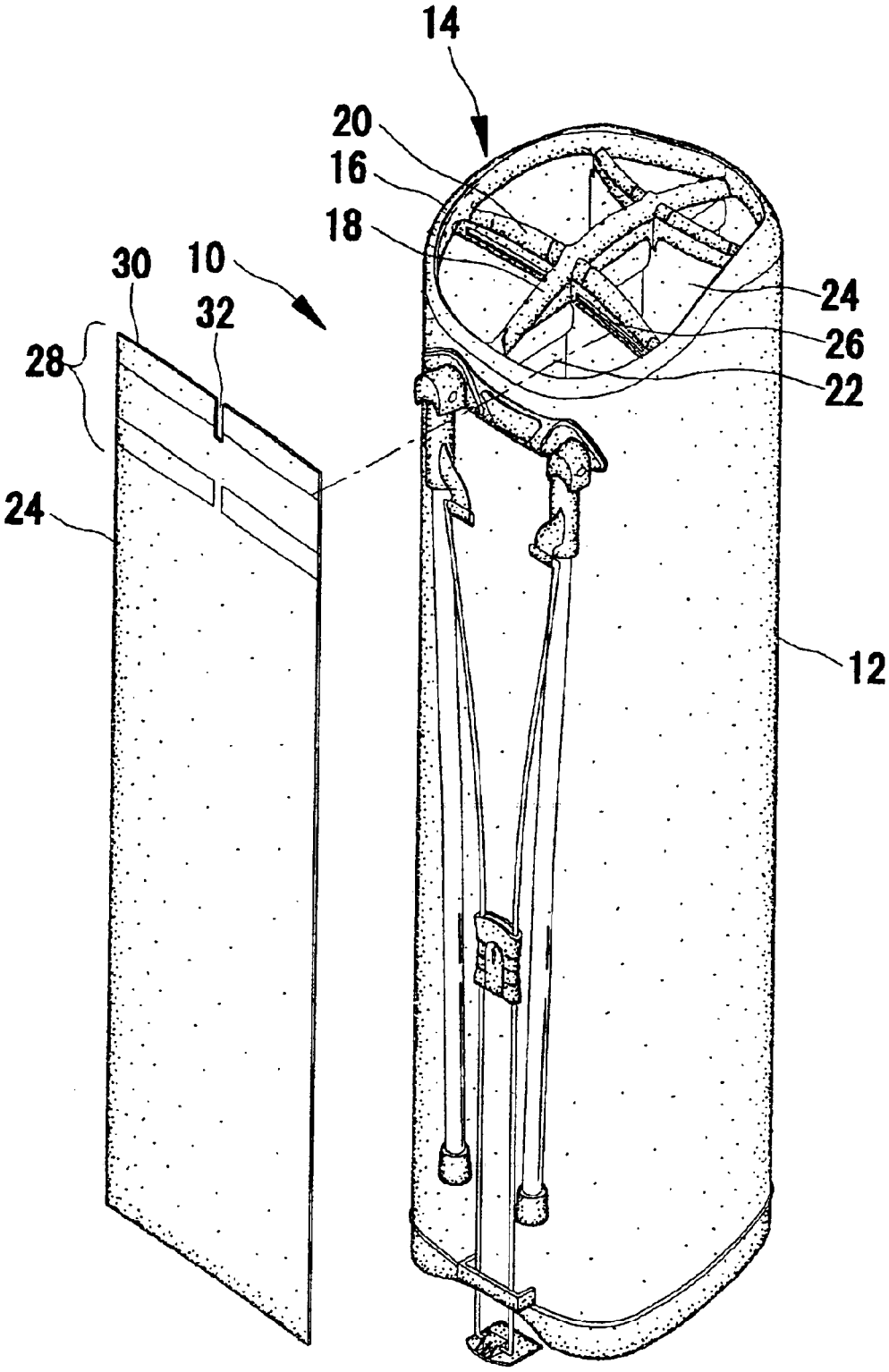
FIG. 3 is an exploded view of the club-carrying apparatus of FIG. 2.

Referring to FIG. 3, the sternum-like element 18 and the rib-like elements 20 all define a plurality of slots 26. The sternum-like element 18 defines three slots 26. Each of the rib-like elements 20 defines two slots 26.

Figure 4:
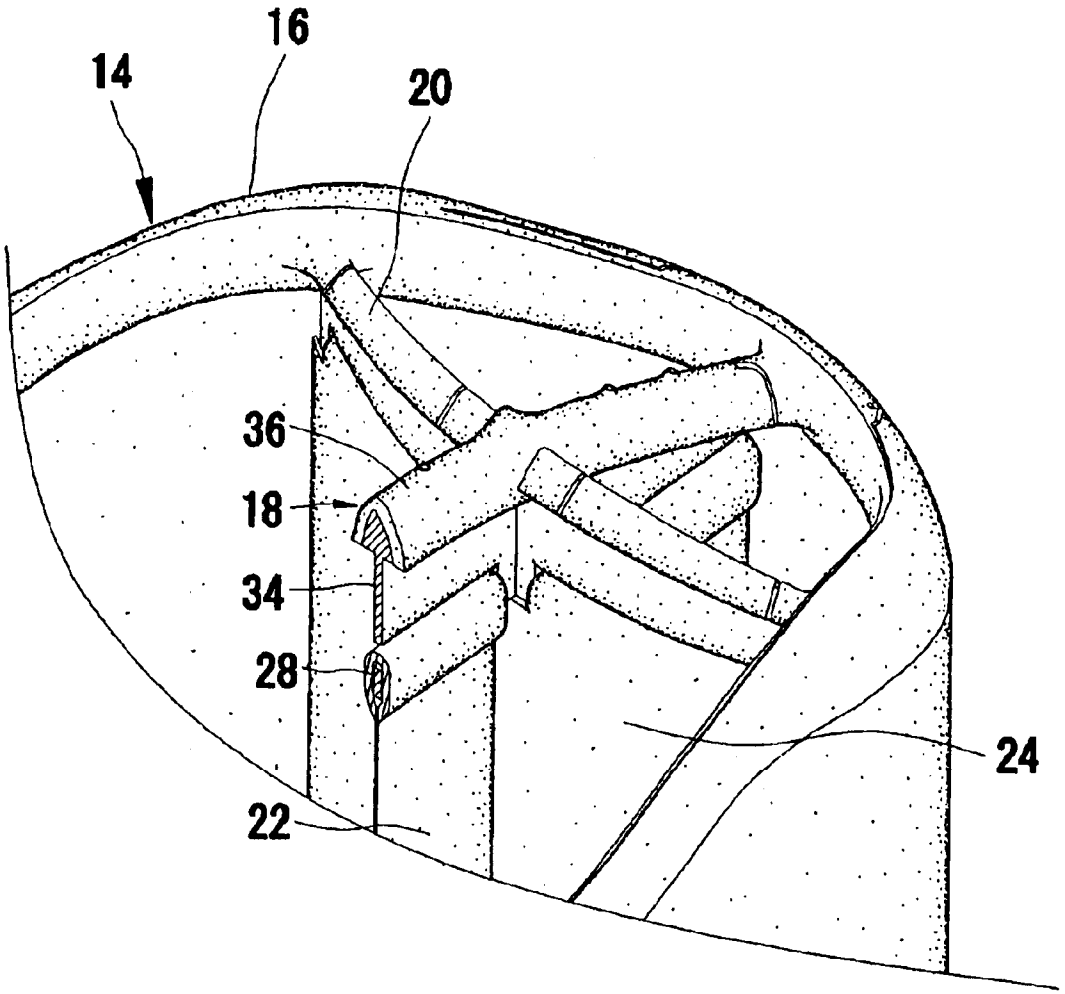
FIG. 4 is a cut-away partial view of the club-carrying apparatus of FIG. 2.
Figure 5:
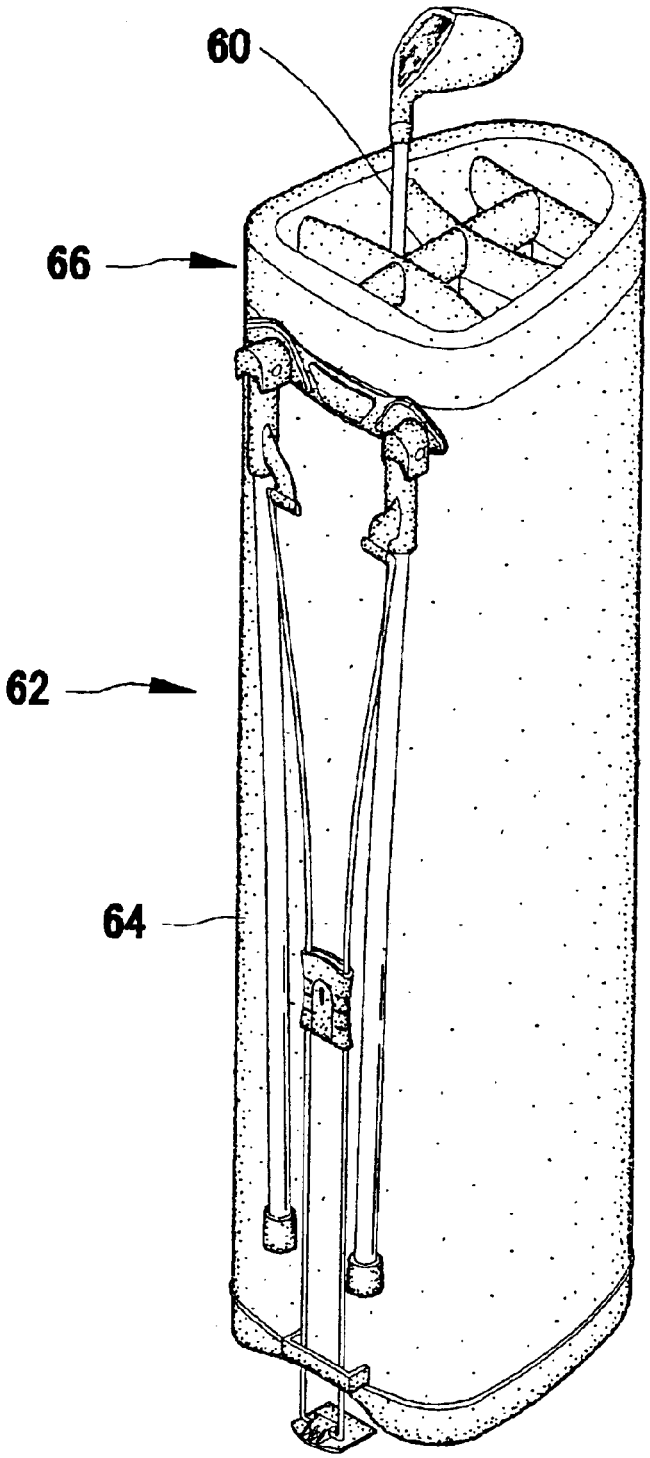
Fig. 5 PRIOR ART
FIG. 5 is a perspective view of a golf club inserted in a conventional club-carrying apparatus.
Figure 6:
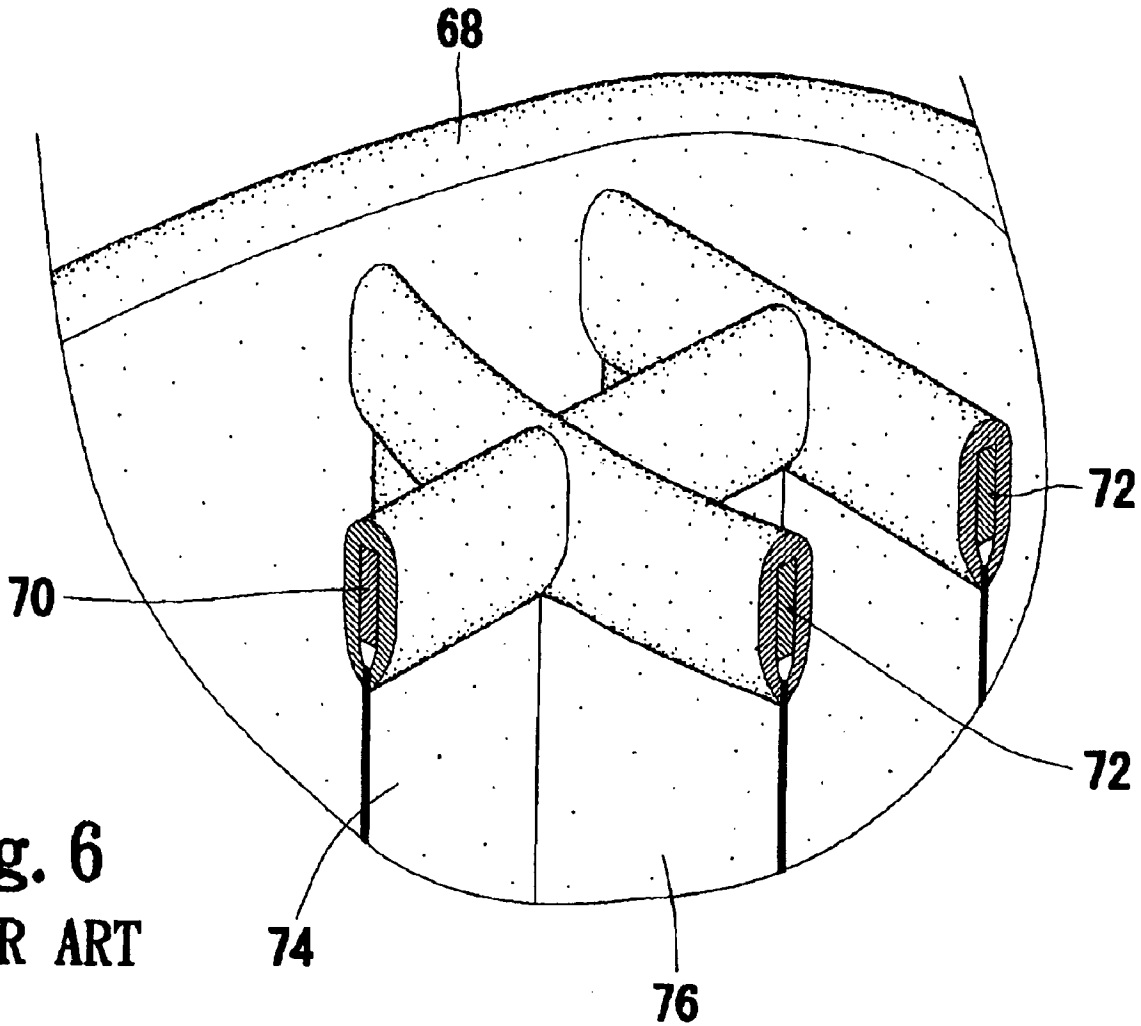
Fig. 6 PRIOR ART
FIG. 6 is a cut-away partial view of the club-carrying apparatus of FIG. 5.

Referring to FIG. 4, each of the partitions 22 includes an upper portion inserted through one of the slots 26 of the sternum-like element 18. The upper portion of each partition 22 is attached to another portion of that partition 22 via hook-and-loop fasteners 28.

The upper portions of the partitions 22 and 24 can, of course, be attached to the sternum-like element 18 and the rib-like elements 20 sewing, adhesion or in any other proper manners.

Referring to FIG. 3, each of the partitions 24 includes an upper portion from which two strips 30 extend. The strips 30 of each partition 24 are separated from each other by a slit 32. Each strip 30 of each partition 24 is inserted through one slot 26 of one rib-like element 20 and attached to another portion of that partition 24 via hook-and-loop fasteners 28. The slit 32 of each partition 24 encompasses the sternum-like element 18.

Although not shown, each partition 24 with two strips 30 can be replaced with two narrower partitions with only one strip.

Referring to FIG. 4, the sternum-like element 18 includes a bone 34 and a skin 36 mounted on the bone 34. The bone 34 is made of a proper rigid material. The skin 36 is made of a proper soft material. The bone 34 includes a lower portion defining the slots 26. The bone 34 includes an upper portion that is enlarged for contact with the golf clubs. Thus, it is ensured that the upper portions of the partitions 22 will not be worn out by the golf clubs. The bone 34 and the skin 36 may be molded as one piece or separately molded and adhered to each other.

Although not shown, the rib-like elements 20 all include a configuration similar to that of the sternum-like element 18.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A club-carrying apparatus including:

a bag;

a frame including an annular element attached to an upper portion of the bag, a sternum element extending from the annular element and including a bone and a skin covering the bone, and at least one rib element intersecting the sternum element and including a bone and a skin covering the bone;

a plurality of first partitions each including a lower portion attached to the bag and an upper portion attached to the bone of the sternum element; and at least one second partition including a lower portion attached to the bag and an upper portion attached to the bone of the rib element, wherein the bone of the sternum element defines a plurality of slots, and each of the first partitions includes an upper portion inserted through one of the slots and attached to another portion of that first partition.

2. The club-carrying apparatus according to claim 1 wherein the bone of the sternum element is made of a rigid material.

3. The club-carrying apparatus according to claim 1 wherein the skin of the sternum element is made of a soft material.

4. The club-carrying apparatus according to claim 1 wherein the bone of the sternum element includes an enlarged upper portion covered by the skin.

5. The club-carrying apparatus according to claim 1 wherein the bone of the sternum element includes an enlarged upper portion covered by the skin.

6. A club-carrying apparatus including:

a bag;

a frame including an annular element attached to an upper portion of the bag, a sternum element extending from the annular element and including a bone and a skin covering the bone, and at least one rib element intersecting the sternum element and including a bone and a skin covering the bone;

a plurality of first partitions each including a lower portion attached to the bag and an upper portion attached to the bone of the sternum element; and at least one second partition including a lower portion attached to the bag and an upper portion attached to the bone of the rib element, wherein the bone of the rib element defines a plurality of slots, and the second partition includes two strips extending from an upper portion thereof, and the strips of the second partition are inserted through the slots and attached to other portions of the second partition.

7. The club-carrying apparatus according to claim 6 wherein the bone of the rib element is made of a rigid material.

8. The club-carrying apparatus according to claim 6 wherein the skin of the rib element is made of a soft material.

9. The club-carrying apparatus according to claim 6 wherein the bone of the rib element includes an enlarged upper portion covered by the skin.

10. A club-carrying apparatus including:

a bag;

a frame including an annular element attached to an upper portion of the bag, a sternum element extending from the annular element and including an upper portion and a reduced lower portion, and at least one rib element intersecting the sternum element and including an upper portion and a reduced lower portion, wherein the lower portion of the rib element defines a plurality of slots;

a plurality of first partitions each including a lower portion attached to the bag and an upper portion attached to the lower portion of the sternum element; and at least one second partition including a lower portion attached to the bag and an upper portion attached to the lower portion of the rib element, wherein the second partition includes two strips extending from an upper portion thereof, and the strips of the second partition are inserted through the slots and attached to other portions of the second partition.

11. A club-carrying apparatus including:

a bag;

a frame including an annular element attached to an upper portion of the bag, a sternum element extending from the annular element and including an upper portion and a reduced lower portion, wherein the lower portion of the sternum element defines a plurality of slots, and at least one rib element intersecting the sternum element and including an upper portion and a reduced lower portion;

a plurality of first partitions each including a lower portion attached to the bag and an upper portion attached to the lower portion of the sternum element; and at least one second partition including a lower portion attached to the bag and an upper portion attached to the lower portion of the rib element, wherein each of the first partitions includes an upper portion inserted through one of the slots and attached to another portion of that first partition.

12. A club-carrying apparatus including:

a bag;

a frame including an annular element attached to an upper portion of the bag, a sternum element extending from the annular element and including a bone and a skin covering the bone, and at least one rib element intersecting the sternum element and including a bone and a skin covering the bone;

a plurality of first partitions each including a lower portion attached to the bag and an upper portion attached to the sternum element; and a plurality of second partitions each including a lower portion attached to the bag and an upper portion attached to the rib element, wherein the bone of the sternum element defines a plurality of slots, and each of the first partitions includes an upper portion inserted through one of the slots and attached to another portion of that first partition.

13. A club-carrying apparatus including:

a bag;

a frame including an annular element attached to an upper portion of the bag, a sternum element extending from the annular element and including a bone and a skin covering the bone, and at least one rib element intersecting the sternum element and including a bone and a skin covering the bone;

a plurality of first partitions each including a lower portion attached to the bag and an upper portion attached to the sternum element; and a plurality of second partitions each including a lower portion attached to the bag and an upper portion attached to the rib element, wherein the bone of the rib element defines a plurality of slots, and each of the second partitions includes an upper portion inserted through one of the slots and attached to another portion of that second partition.

* * * * *